United States Patent [19]

van Huuksloot

[11] 4,395,066

[45] Jul. 26, 1983

[54] GRAB

[75] Inventor: Leendert van Huuksloot, Zevenbergschen Hoek, Netherlands

[73] Assignee: Nemag B.V., Zierikzee, Netherlands

[21] Appl. No.: 267,660

[22] Filed: May 27, 1981

[30] Foreign Application Priority Data

May 30, 1980 [NL] Netherlands ..... 8003176

[51] Int. Cl.[3] ..... B66C 3/12

[52] U.S. Cl. ..... 294/70; 37/185; 294/112

[58] Field of Search ..... 294/70, 86 R, 106, 107, 294/111, 112, 118; 37/183 R, 184, 185, 186, 188; 414/624

[56] References Cited

U.S. PATENT DOCUMENTS

| | | | |
|---|---|---|---|
| 559,384 | 5/1896 | Hunt | 294/70 |
| 707,484 | 8/1902 | Wirsing | 37/185 |
| 1,153,950 | 9/1915 | Peterson | 37/185 |
| 2,205,325 | 6/1940 | Venable | 37/188 |
| 3,807,783 | 4/1974 | Huuksloot | 294/70 |

FOREIGN PATENT DOCUMENTS

| | | | |
|---|---|---|---|
| 1092405 | 4/1955 | France | 37/185 |

*Primary Examiner*—Johnny D. Cherry

*Attorney, Agent, or Firm*—Scully, Scott, Murphy & Presser

[57] ABSTRACT

A grab comprising a pair of buckets interconnected by way of arms capable of pivoting movement relative to each other, and the free ends of which are provided with sheaves for guiding operating or closing ropes by which the buckets can be opened and closed. The rear edges of the buckets are secured by way of ropes or the like to a cross-beam, to which the hoist ropes are connected. According to the invention, the arms are provided at some distance from their free ends with arcuate bridge members or elevations, directed to one another, which roll one over the other as the grab buckets are opened and closed.

5 Claims, 4 Drawing Figures

GRAB

This invention relates to a grab of the type comprising a pair of buckets connected to arms capable of pivoting movement relative to each other, and the free ends of which are provided with means for guiding operating ropes with which the grab buckets can be opened and closed, the rear edges of the buckets being connected by means of ropes or the like to a cross-beam, with which hoist ropes are connected.

Such a grab is generally known. The arms of the grab pivot in a shaft which must be of robust and reliable construction, while the bearing must satisfy very high demands.

Owing to rough handling of the grab, for example in the docks, it may occur that, as a result of bumping and dropping on cargo, for example ore, deformations occur in the shaft and/or the bearing thereof. Repairs on the site are hardly, if at all, possible, so that these are expensive affairs and in addition the grab is sometimes out of service for a longer period of time. Deformations often require replacement of a part, and also of the bearing, so that there is a need for a pivot construction which does not exhibit the drawbacks referred to.

According to the invention, this is achieved by providing the arms at some distance from their free ends with bridge members directed to one another and forming arcuate elevations, which bridge members roll one over the other as the grab buckets are opened and closed. Naturally, a combination of a flat and an arcuate bridge member is also possible.

In this construction, a pivot in the form of an expensive shaft and a likewise expensive bearing can be dispensed with altogether, so that the construction as a whole is less vulnerable to impacts and can be readily and rapidly repaired.

As the arcuate bridge members roll one over the other as the grab buckets are opened and closed, there is provided a shifting fulcrum, which has a favourable effect on the force with which the buckets must be closed when taking up or having taken up a charge.

As the contact between the arcuate bridge members is mainly a linear contact, the rolling friction which occurs will be kept to a minimum. The contact point needs no lubrication, and requires no particular supervision or maintenance.

One embodiment of the invention will now be described, by way of example, with reference to the accompanying drawings, in which FIG. 1 shows the grab in the fully opened position;

Figure 1:
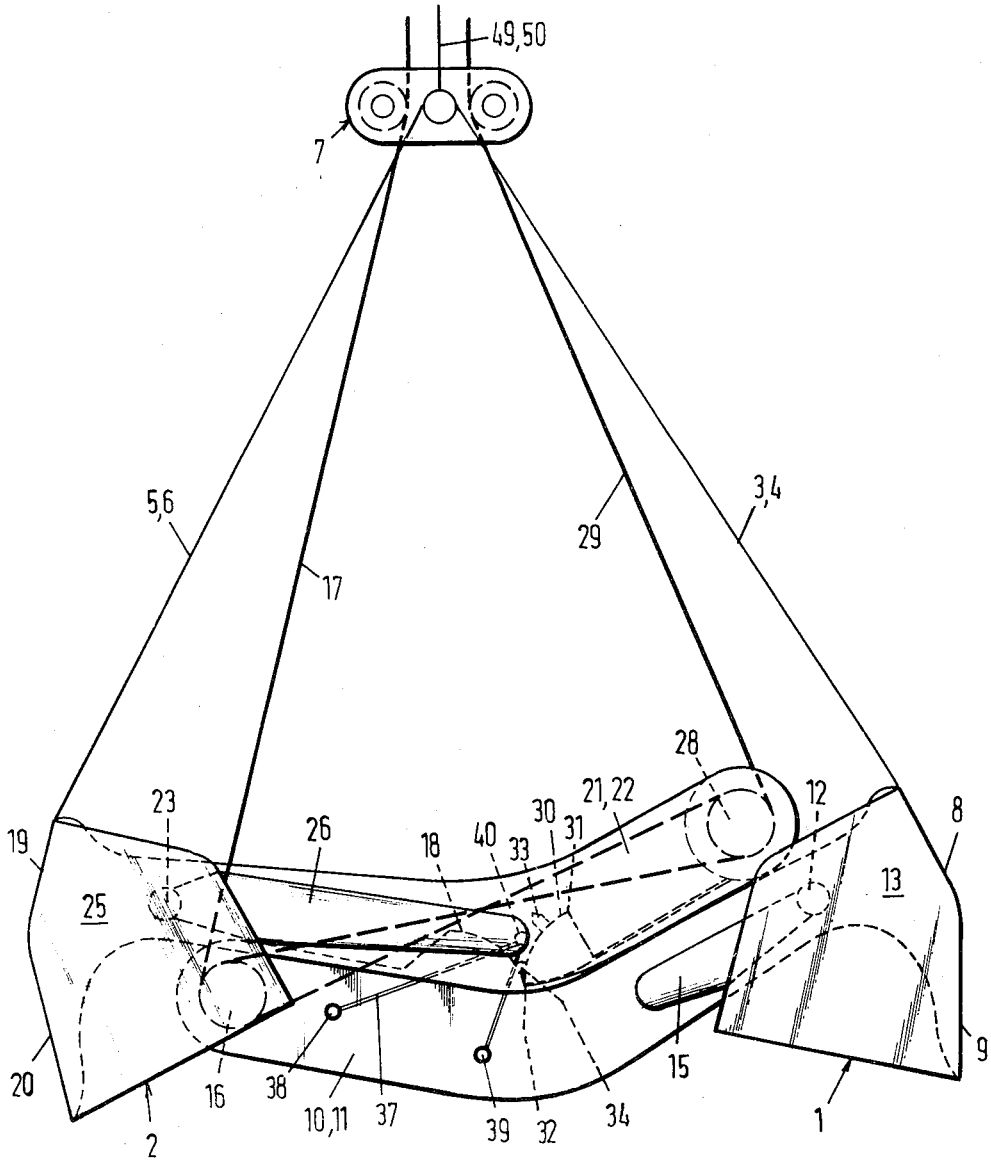
Figure 2:
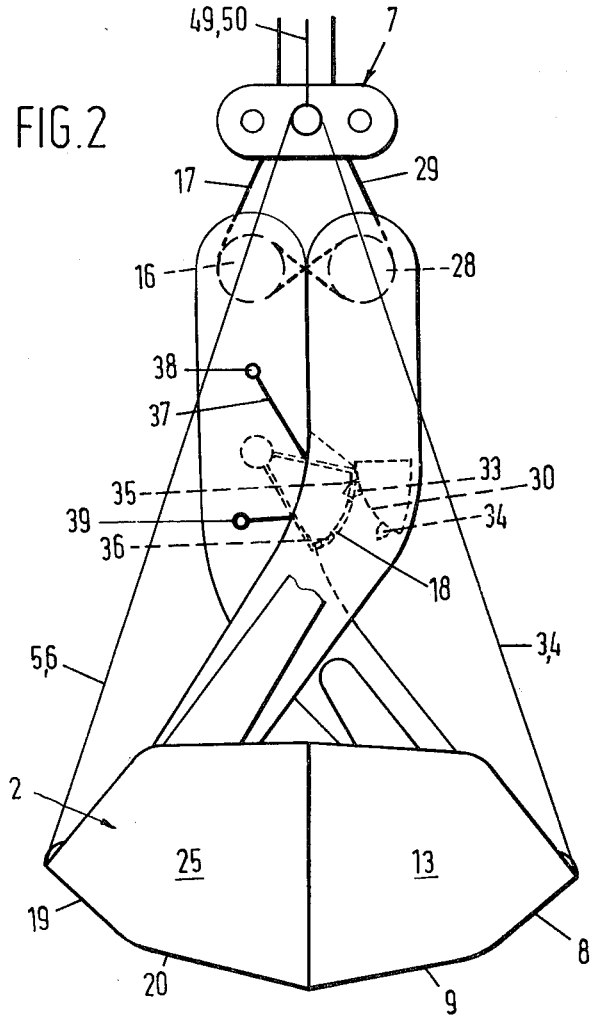
FIG. 2 shows the grab in the fully closed position.
Figure 3:
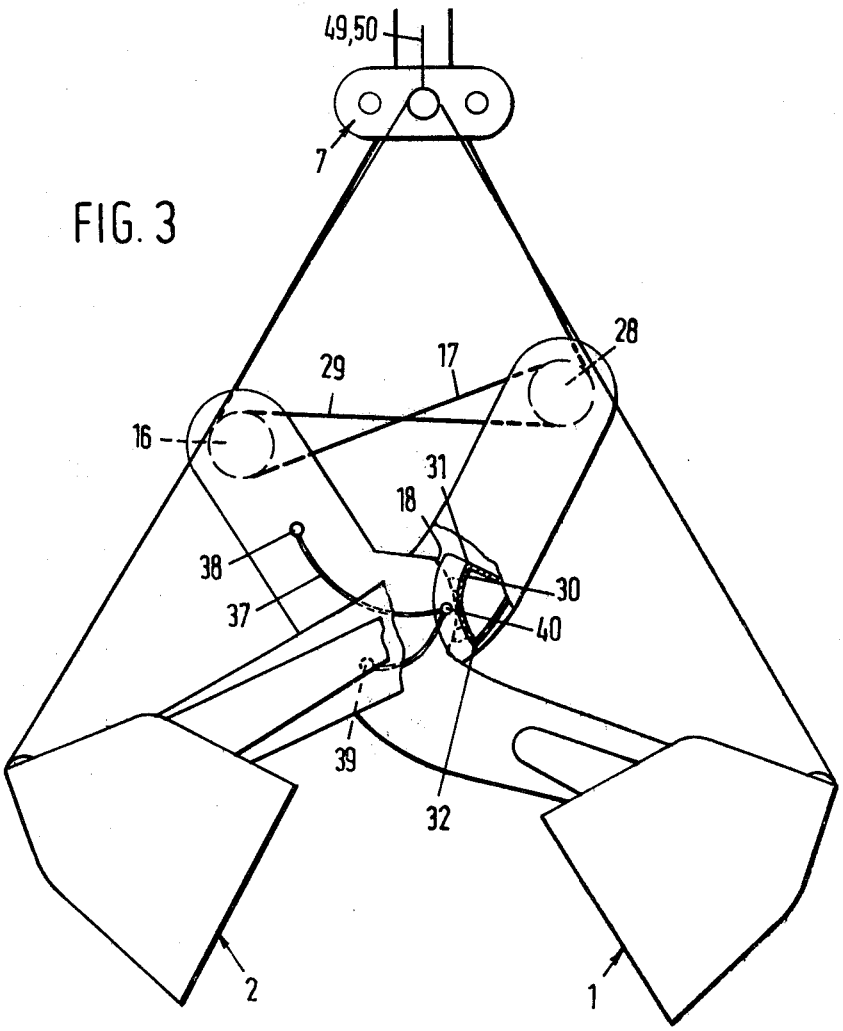
FIG. 3 shows the grab in an intermediate position.
Figure 4:
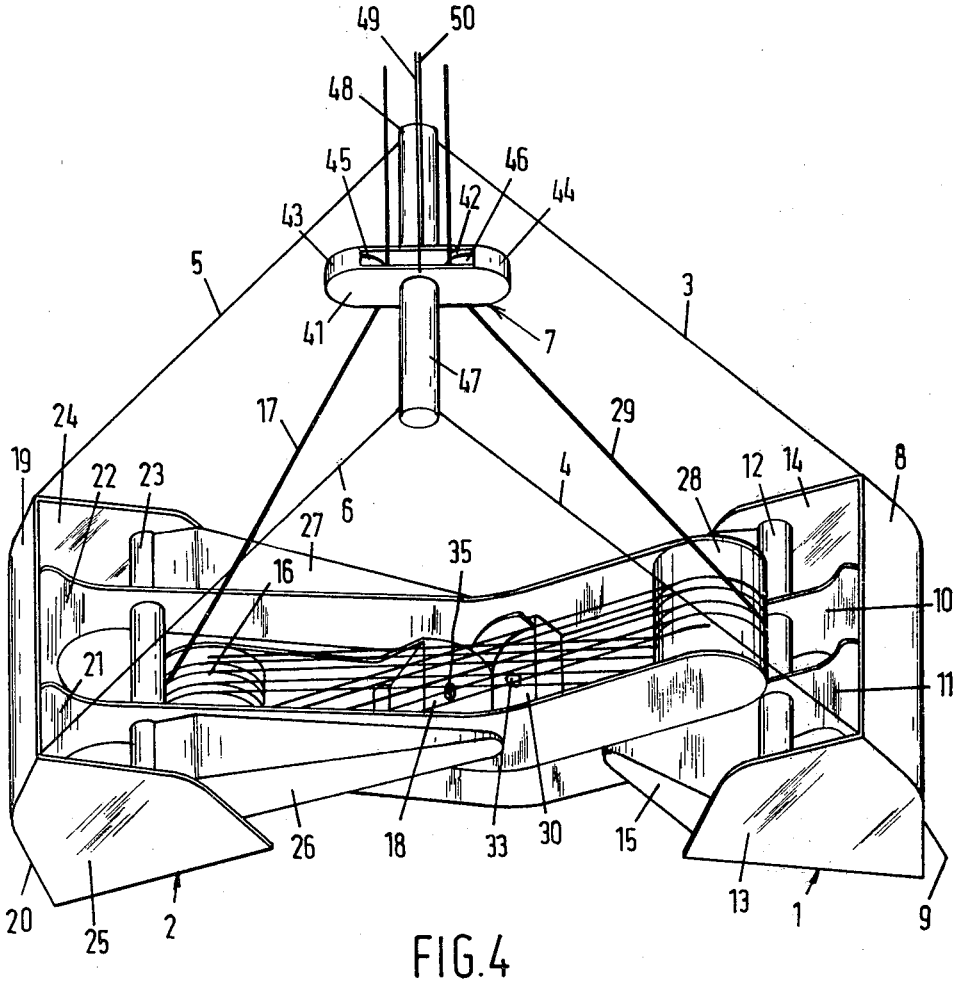
FIG. 4 is a perspective top view of the fully opened grab.

Grab buckets 1 and 2 are connected with their rear edges by means of ropes 3, 4 and 5, 6 to a cross-beam 7.

The arms of the grab are formed by plates each secured, on the one hand to a grab beam, and, on the other hand, comprising the guide sheaves for the ropes with which the buckets can be opened and closed.

Grab bucket 1 is connected with its rear wall 8 and bottom 9 to plate members 10 and 11, for example by means of welding. There is also provided a stiffening member 12, by means of which the plate members are secured to the sidewalls 13 and 14 of bucket 1. An additional stiffening member between sidewall 13 and plate member 11 is shown at 15.

Provided at the free end of the arms formed by plate members 10 and 11 are guide sheaves 16 for rope 17, with which buckets 1 and 2 can be opened and closed.

Provided between plate members 10 and 11, at some distance from sheaves 16, is an arcuate elevation 18, which forms one of the members of a rolling pivot, about which the arms can move.

Grab bucket 2 has its rear wall 19 and bottom 20 connected to plate members 21 and 22 which form the other arm of the grab. Shown at 23 is a stiffening cross-member between plate members 21 and 22 and sidewalls 24 and 25 of bucket 2. Additional stiffening members 26 and 27 are provided between plate members 21 and 22 and sidewalls 24 and 25 of bucket 2.

Provided at the free end of the grab arm formed by plate members 21 and 22 are guide sheaves 28, about which rope 29 is passed, with which buckets 1 and 2 can be opened and closed.

Spaced some distance from sheaves 28 intermediate plate members 21 and 22 is an arcuate elevation 30, which forms part of a rolling pivot about which the arms turn as the buckets are opened and closed. During this movement the arcuate surfaces of elevations 18 and 30 roll or revolve one over the other.

For fixing the various positions of the arms, each arcuate elevation 30 has a pin-shaped projection 33, 34 at least adjacent the edges 31 and 32. Provided in arcuate elevations 18 are complementary recesses 35 and 36, capable of receiving a pin-shaped projection in a respective final position. As an alternative embodiment arcuate member 30 can be provided with tooth segments which mesh with tooth segments on arcuate member 18.

In order to prevent undesirable displacements between the arms, for example as a result of shocks and impacts, there is provided a flexible connection in the form of a rope 37, which is fixed in points 38, 39 and 40. The rope need not take up any appreciable forces. For considerations of symmetry, a corresponding connection is provided at the other end of the arms.

As the bearing point between the bridge members is displaced, there is a difference in length of rope between the closing ropes in the opened and the closed position of the grab. This difference, however, is compensated by the cross-beam, which is capable of occupying an inclined position and functions as an equalizing member.

It is also possible to keep the length of the closing ropes in the fully opened and fully closed position of the grab equal by securing the end of one closing rope above the guide sheaves, and that of the other closing rope under the guide sheaves.

Cross-beam 7, as shown in the drawing, comprises two spaced plates 41 and 42, interconnected at their ends by hoods 43 and 44. Located within these hoods are guide sheaves 45 and 46 for operating cables 17 and 29.

Ropes 3, 4, 5 and 6, which are connected to the rear walls 8 and 19 of buckets 1 and 2 are connected at their other end to the cross-beam. For this purpose the cross-beam is provided with elongated projections 47 and 48. Naturally, ropes 3, 4, 5 and 6 may be secured to the cross-beam in other manners.

Secured in the central portion of the cross-beam are hoist ropes 49 and 50, which may be secured in any desired manner.

As the closing ropes 17 and 29 extend via sheaves 45, 46 to the outside of sheaves 16 and 28 of buckets 1 and 2, a strong torque is generated, which when the buckets are closed causes a large closing force, while the load is distributed in a favourable manner in the closing ropes by the cross-beam.

As the bridge members turn one over the other as the grab buckets are moving towards and away from each other, this is matter of a shifting contact point or fulcrum. The frictional forces occurring in this connection may be kept to a minimum, which has a favourable effect on the service life of the pivots. As, during the closing movement, ropes 17 and 29 cause outwardly and upwardly directed forces to be applied to sheaves 45 and 46, the cross-beam will move upwardly when there is a certain tension in the ropes, which promotes trouble-free operation of the grab.

It is noted that the use of the cross-beam 7 as shown and discussed above, is not limited to the type of grab according to the present invention.

As the contact point between the bridge members is displaced as the bridge members roll one over the other, this point will mainly be located outside the vertical plane of symmetry through the grab as a whole. The eccentric pivot thus formed causes the force generated during the closing movement to be more favourable than is the case in a grab having a fixed fulcrum located in the plane of symmetry referred to.

What I claim is:

1. A grab comprising a pair of buckets interconnected by arms capable of pivoting movement relative to each other, the free ends of said arms are provided with means for guiding operating or closing ropes by which the buckets can be opened and closed, said buckets have rear edges secured by means of hoist ropes or the like to a cross-beam, to which said hoist ropes are connected, characterized in that the arms are provided at some distance from the free ends with arcuate bridge members forming arcuate elevations directed to one another, and as the grab buckets are opened and closed the contact point between said bridge members is displaced as said bridge members and said arcuate elevations roll one over the other.

2. A grab as claimed in claim 1, characterized in that one of the arcuate elevations is provided at least adjacent each transverse edge with a pin-shaped projection, while the other arcuate elevation is provided at least adjacent each transverse edge with a complementary recess or cut-out, capable of receiving said pin-shaped projection.

3. A grab as claimed in claim 1, characterized in that said elevations are formed with meshing tooth segments.

4. A grab as claimed in claims 1 or 2 or 3, characterized in that the arms are interconnected by a rope at the points where the bridge members are provided.

5. A grab as claimed in claims 1 or 2 or 3, characterized in that the cross-beam is formed by two plates spaced some distance from each other, and provided adjacent their ends with guide sheaves located intermediate said plates, the plates being provided in their center with means for securing the hoist rope and for the ropes to which the rear edges of the grab buckets are secured.

* * * * *